US010001264B2

(12) United States Patent
Zhou

(10) Patent No.: US 10,001,264 B2
(45) Date of Patent: Jun. 19, 2018

(54) ENERGY-SAVING RECYCLABLE DISPLAY SYSTEM

(71) Applicant: Shenzhen Leyeah Packaging Design Co., Ltd., Shenzhen, Guangdong (CN)

(72) Inventor: Yanlin Zhou, Jiangxi (CN)

(73) Assignee: Shenzhen Leyeah Packaging Design Co., Ltd., Shenzhen (CN)

( * ) Notice: Subject to any disclaimer, the term of this patent is extended or adjusted under 35 U.S.C. 154(b) by 119 days.

(21) Appl. No.: 15/278,002

(22) Filed: Sep. 27, 2016

(65) Prior Publication Data

US 2018/0058672 A1 Mar. 1, 2018

(30) Foreign Application Priority Data

Aug. 26, 2016 (CN) ..... 2016 1 0740329

(51) Int. Cl.

| | |
|---|---|
| ***F21V 21/116*** | (2006.01) |
| ***B65D 75/56*** | (2006.01) |
| ***F21V 3/02*** | (2006.01) |
| ***F21V 21/08*** | (2006.01) |
| ***F21V 23/06*** | (2006.01) |
| ***F21V 23/02*** | (2006.01) |
| ***F21V 23/04*** | (2006.01) |

(52) U.S. Cl.

CPC ..... *F21V 21/116* (2013.01); *B65D 75/563* (2013.01); *F21V 3/02* (2013.01); *F21V 21/0832* (2013.01); *F21V 23/02* (2013.01); *F21V 23/04* (2013.01); *F21V 23/06* (2013.01)

(58) Field of Classification Search

CPC .... F21V 21/116; F21V 21/0832; F21V 23/06; F21V 23/04; B65D 75/563

See application file for complete search history.

(56) References Cited

U.S. PATENT DOCUMENTS 4,739,883 A * 4/1988 Mohs ..... B65D 73/00 206/461

5,411,140 A * 5/1995 Byer ..... B65D 21/0202 206/459.5

* cited by examiner

*Primary Examiner* — Karabi Guharay

(57) ABSTRACT

An energy-saving recyclable display system, comprising a display stand, a packaging container and a suspension loop; a display rod is arranged on the display stand, the packaging container and the suspension loop are mounted in a dismountable way; a suspension notch is arranged on the upper part of the suspension loop; the lower part of the suspension loop is opened and stretches into the packaging container; the suspension loop is hollow inside and mounted with a circuit board and an illuminant; an electric wire is arranged on the circuit board; a conductive contact is arranged at the end of the electric wire protruding from the inner side face of the suspension notch; the conductive contact contacts with the display rod and forms a switched-on circuit. The product in the packaging container presents a favorable luminous effect when it is displayed.

9 Claims, 3 Drawing Sheets

ENERGY-SAVING RECYCLABLE DISPLAY SYSTEM

CROSS-REFERENCE TO PRIOR APPLICATION

This application claims the benefit of Chinese Patent Application No. 201610740329.0 filed on Aug. 26, 2016, the contents of which are incorporated herein by reference.

TECHNICAL FIELD

The Invention relates to the field of display devices, and particularly to an energy-saving recyclable display system.

BACKGROUND ART

The ultimate purpose of the overwhelming TV advertisements, outdoor advertisements, and those on network, magazines, newspapers and we-media is to seize every possibility to promote the brand images and make them easy to be remembered by consumers. However, in today's environment of advertisement overflow, apparently advertisement cannot be a main force in marketing any longer. Meanwhile, internet sales mode causes huge impact to brick-and-mortar shops, and various bands suffer a lot from the price war brought about by internet sales. Therefore, many brands start to keep an eye on packaging, expecting the brand can be attractive to consumers in brick-and-mortar shops through a novel packaging and finally achieve success. As the way of packaging and display is a static medium in product terminal sales, it is a key element to stand out from numerous brands.

But how to attract consumers in an instant when they enter in a large shopping mall full of various homogenized products simply displayed? Currently, the innovation in packaging is limited to materials, structures, drawings and surface processes, and meanwhile, the limitation of product type and distribution channel always makes the surface innovation in a rut. Therefore, how to combine the methods of traditional packaging and modern display, i.e., how to cooperate the packaging body with light and present a novel effect of display from the inside out, is an important direction of packaging design at present.

SUMMARY OF THE INVENTION

The purpose of the Invention is to provide an energy-saving recyclable display system, through which the product in the packaging container may present a favorable luminous effect; meanwhile, the luminance can be controlled in real time and the suspension loop can be recycled.

To achieve the above purpose, the technical scheme of the Invention is concerned with an energy-saving recyclable display system, comprising a display stand, a packaging container and a suspension loop; wherein, a display rod is arranged on the display stand; the packaging container and the suspension loop are mounted in a dismountable way; a suspension notch is arranged on the upper part of the suspension loop; the lower part of the suspension loop is opened and stretches into the packaging container; the suspension loop is hollow inside and mounted with a circuit board and an illuminant; the illuminant is electrically connected to the circuit board; an electric wire is arranged on the circuit board; a conductive contact is arranged at the end of the electric wire, protruding from the inner side face of the suspension notch; the conductive contact contacts with the display rod and forms a switched-on circuit; a power supply or a port that connects to an external power supply is arranged on the circuit board.

Preferably, the suspension loop comprises a symmetrically arranged front shell and rear shell, and a splint; a half cylinder is arranged near both sides of the upper surface of the front shell; a half stop block is arranged at the tail end of the half cylinder; both front and rear shells are spliced into an invertible T-shaped hollow suspension loop shell; the upper surface of the suspension loop shell forms a cylinder and the tail end of the cylinder forms a stop block; a limit hole corresponding to the stop block is arranged on the splint; the circuit board is mounted in the spliced body of the front and rear shells of the suspension loop; the illuminant is arranged on the lower part of the circuit board and electrically connected to the circuit board.

Preferably, a semitransparent light guiding shell is arranged on the lower part of the illuminant, connecting to the lower part of the suspension loop shell.

Preferably, the stop block is round pie-shaped or cone-shaped and the bottom of the stop block horizontally protrudes outward.

Preferably, the section shape of the limit hole is matched with that of the stop block and the sectional area is slightly smaller than that of the stop block.

Preferably, the packaging container is a packaging box or bag.

Preferably, the circuit board and the illuminant are electrically connected through a switch; the switch is arranged outside of the suspension loop.

Through the above technical scheme, the suspension loop and the packaging container are easy to be mounted because they are connected in a dismountable way; a built-in illuminant which is powered up either through an internal power supply or an external power supply is arranged in the suspension loop; while powered on, the conductive contact and the display rod are connected to form a switched-on circuit, making the illuminant give out light and the product in the packaging container present a favorable luminous effect when it is displayed; meanwhile, the luminance can be controlled in real time through the external power supply, or by separating the suspension loop and the display rod, resulting in energy saved and environment protected; the suspension loop can be dismounted for cyclic utilization or ordinary lighting, avoiding waste of materials.

Marks in the Figures are as follows: 1—display stand; 11—display rod; 2—suspension loop; 21—rear shell of suspension loop; 22—front shell of suspension loop; 221—half cylinder; 222—half stop block; 23—circuit board; 24—splint; 241—limit hole; 242—strip-shaped hole; 25—light guiding shell; 3—packaging container.

DETAILED DESCRIPTION OF THE PREFERRED EMBODIMENTS

The Invention is further described in combination with drawings and embodiments as follows. It shall be noted that, description of these embodiments is only for further understanding of the Invention, and does not form a restriction thereby. Moreover, the technical features related to the embodiments of the Invention described as follows can combine with each other when they do not conflict with each other.

Figure 1:
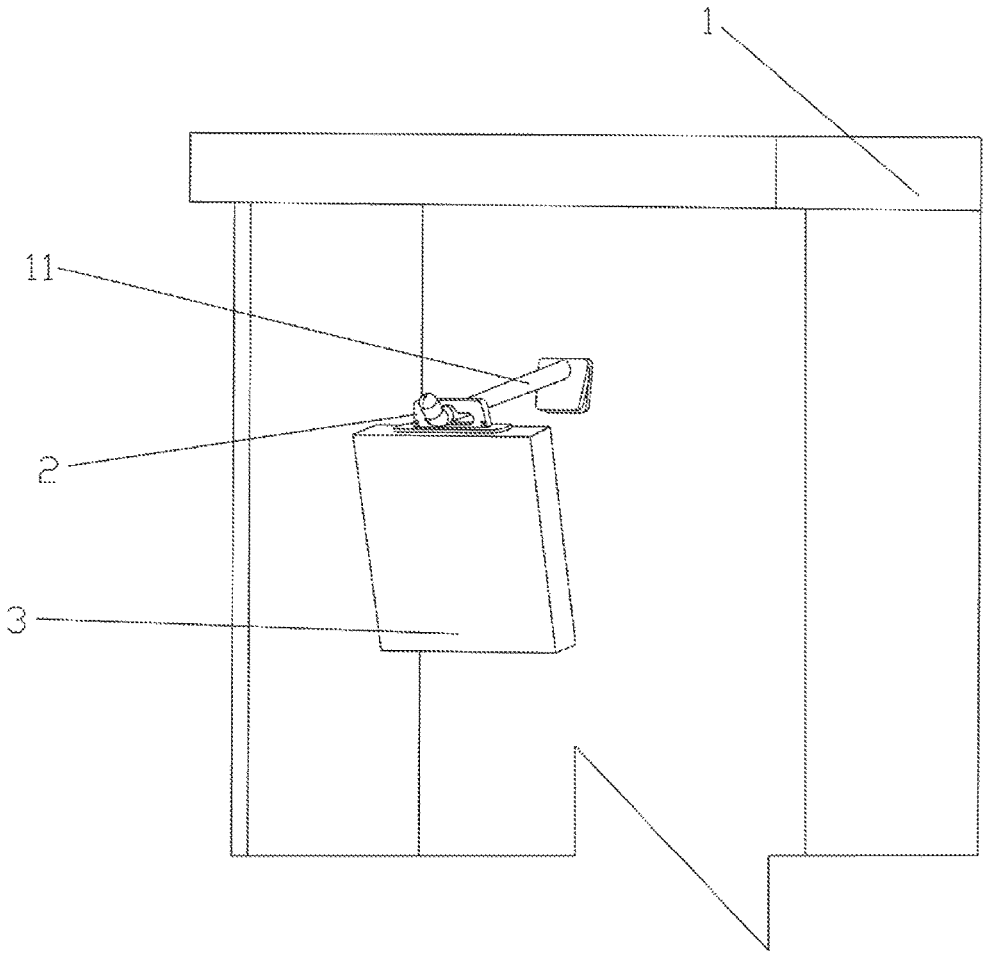
FIG. 1 is a mounting diagram of the energy-saving recyclable display system of the Invention.
Figure 2:
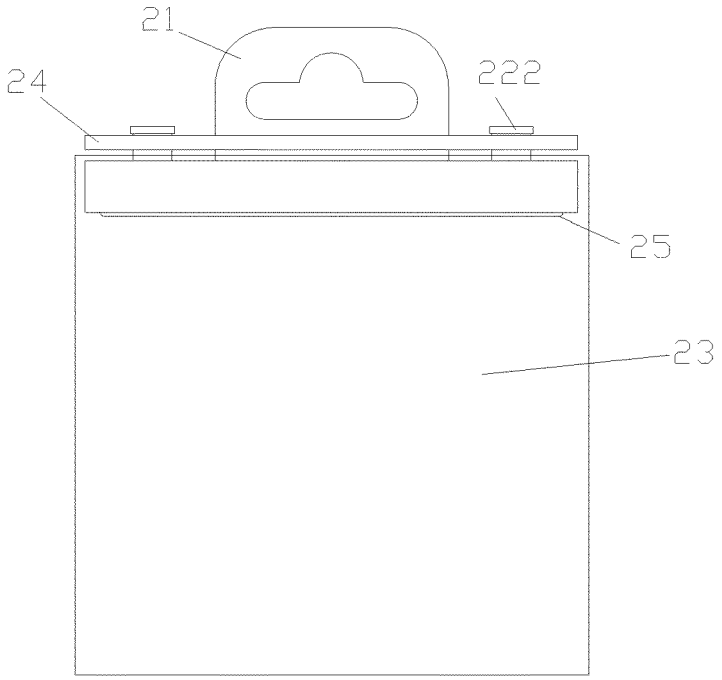
FIG. 2 is a mounting diagram of the suspension loop and the packaging container of the Invention.
Figure 3:
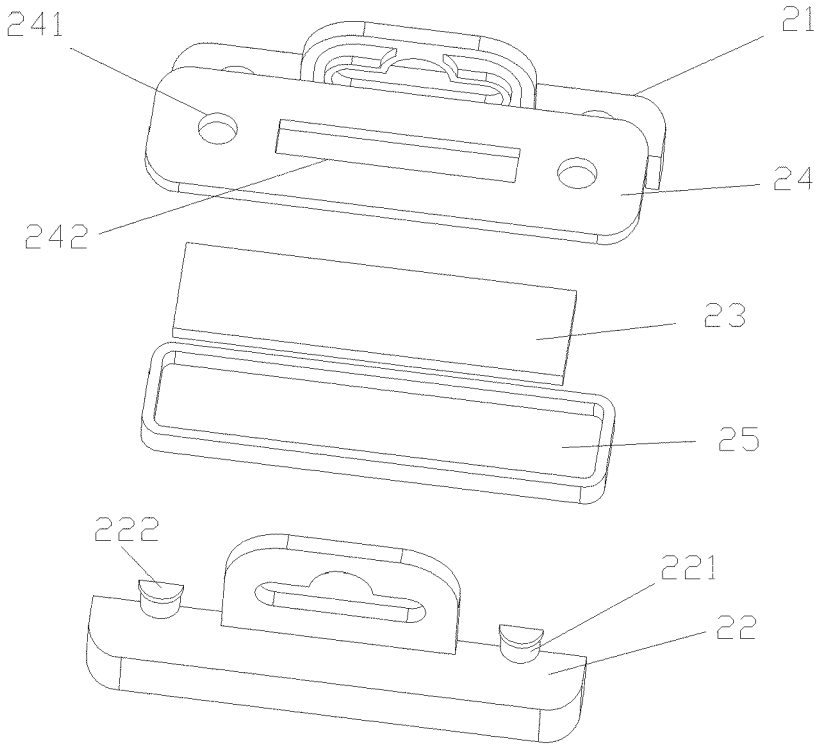
FIG. 3 is an explosive view of the suspension loop of the Invention.
Figure 4:
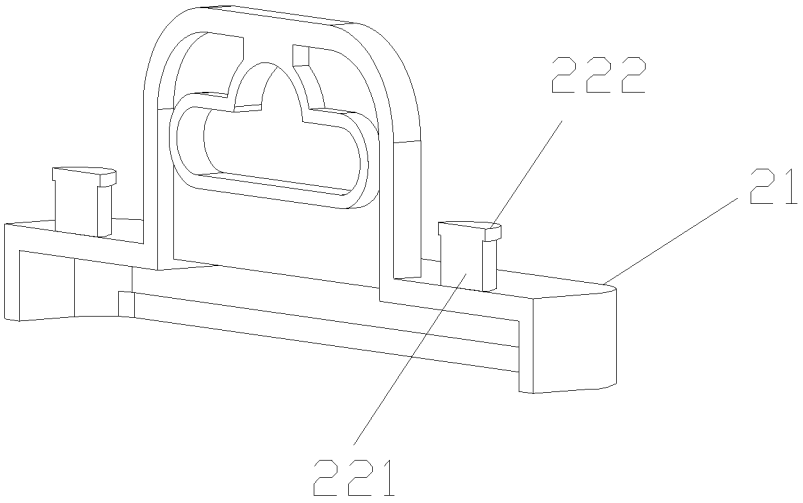
FIG. 4 is an internal structural drawing of the front shell of the suspension loop of the Invention.

An energy-saving recyclable display system, as shown in FIG. 1 to FIG. 4, comprising a display stand 1, a packaging container 3 and a suspension loop 2; a display rod 11 is arranged on the display stand 1, the packaging container 3 and the suspension loop 2 are mounted in a dismountable way; wherein, the suspension loop 2 comprises the symmetrically arranged front shell 22 and rear shell 21, a splint 24, a circuit board 23 and an illuminant; the front shell 22 and the rear shell 21 are both invertible T-shaped and can be spliced into a semi-closed suspension loop shell which is hollow inside and with an opened bottom; a suspension notch is arranged on the upper part of the suspension loop, allowing the display rod 11 passing through and thus making the suspension loop hang on the display rod 11. The lower part of the suspension loop shell stretches into the packaging container 3, and the circuit board 23 and the illuminant are mounted in the inner space of the suspension loop shell in the packaging container 3. The illuminant is electrically connected to the circuit board 23. In addition, an electric wire is arranged on the circuit board 23, extending upward along the inside of the suspension loop shell, and two conductive contacts are arranged at the protruded place on both sides of the inner side face of the suspension notch; when the display rod 11 passes through the suspension notch, the two conductive contacts fit closely to the surface of the display rod 11, forming a switched-on circuit with the circuit board 23. A built-in power supply or a port that connects to an external power supply can be arranged on the circuit board 23 to make the illuminant work. While powered on, the two conductive contacts of the suspension loop contact with the display rod 11, forming a switched-on circuit and the external power supply may supply power to the illuminant.

The suspension loop shell is spliced by the symmetrically arranged front shell 22 and rear shell 21; a half cylinder 221 is arranged at the place near the tail end on the surfaces of the front shell 22 and the rear shell 21; a half stop block 222 is arranged on the half cylinder 221; the half cylinders 221 of the front shell 22 and the rear shell 21 can be spliced into a complete cylinder, while the two half stop blocks 222 can be spliced into a complete stop block; the stop block can be round pie-shaped or cone-shaped, or even of other shapes; the place where the stop block connects to the cylinder horizontally protrudes outward; a limit hole 241 corresponding to the cylinder is arranged on the splint 24 and meanwhile, a strip-shaped hole 242 is arranged in the middle of the splint 24 for the upper part of the suspension loop shell to pass through.

When mounted, the upper part of the suspension loop shell spliced by the front shell 22 and the rear shell 21 passes through the strip-shaped hole 242, and the spliced cylinder passes through the limit hole 241. The area of the plane on the stop block connected to the cylinder is slightly larger than the sectional area of the cylinder, therefore, the stop block can pass through the limit hole 241 when the suspension loop shell is pressed hard; when not pressed, the stop block cannot pass through and it can prevent the splint 24 from moving upward or downward; when the limit hole 241 covers on the cylinder, it can prevent the splint 24 from moving leftward and rightward; thus, it maintains the splicing between the front shell 22 and the rear shell 21.

In addition, the light is likely to disperse because of the lower opening of the suspension loop shell, therefore, a semitransparent light guiding shell 25 can be arranged at the opening where the bottom of the illuminant is, stretching into the suspension loop shell with the side face connecting to the inner side face of the suspension loop shell and the upper surface splicing to the inner surface of the suspension loop shell; thus, the light guiding shell 25 can be fixed, and meanwhile the body of light guiding shell 25 can protect and support the circuit board 23 and the illuminant.

In order to realize the real-time switching of the packaging container 3 on the display stand 1 of the invention, a circuit switch can be arranged on the surface of the suspension loop shell, connecting to the circuit board 23 and controlling the luminance of the illuminant; thus, it can save power by preventing the illuminant from giving out light all the time in the suspension loop on the display stand 1.

The packaging container 3 of the Invention is not limited to be packaging boxes or bags, it can be packaging carriers of other forms, as long as it can be connected to the suspension loop in a dismountable way and the illuminant can be arranged in the packaging container 3.

The Invention has no strict limitation on the specification of the illuminant, as long as it can be placed into the suspension loop shell and stretches into the packaging container 3. Meanwhile, the type of the illuminant is also not limited and can be an LED lamp or other types of energy-saving lamp; meanwhile, the illuminant can be of different luminance and different colors, which can be selected as per requirements in the displaying process.

The above is a detailed description for the embodiments of the Invention in combination with drawings, but the embodiments of the Invention are not limited thereby. For a person skilled in the art, various changes and amendments, replacements and deformations made under the premise of not departing from the spirit and essence of the Invention still fall within the protection scope of the Invention.

What is claimed is:

1. An energy-saving recyclable display system, comprising a display stand, a packaging container and a suspension loop; a display rod is arranged on the display stand, wherein, the suspension loop and the packaging container are mounted in a dismountable way; a suspension notch is arranged on the upper part of the suspension loop; the lower part of the suspension loop is opened and stretches into the packaging container; the suspension loop is hollow inside and mounted with a circuit board and an illuminant; the illuminant is electrically connected to a circuit board; an electric wire is arranged on the circuit board; a conductive contact is arranged at the end of the electric wire, protruding from the inner side face of the suspension notch; the conductive contact contacts with the display rod and forms a switched-on circuit; a power supply or a port that connects to an external power supply is arranged on the circuit board.

2. The energy-saving recyclable display system according to claim 1, wherein, the suspension loop comprises a symmetrically arranged front shell and rear shell, and a splint; a half cylinder is arranged near both sides of the upper surface of the front shell; a half stop block is arranged at the tail end of the half cylinder; both front and rear shells are spliced into an invertible T-shaped hollow suspension loop body; the upper surface of the suspension loop body forms a cylinder and the tail end of the cylinder forms a stop block; a limit hole corresponding to the stop block is arranged on the splint; the circuit board is mounted in the spliced body of the front and rear shells of the suspension loop; the illuminant is arranged on the lower part of the circuit board and electrically connected to the circuit board.

3. The energy-saving recyclable display system according to claim 2, wherein, the section shape of the limit hole is matched with that of the stop block and the sectional area is slightly smaller than that of the stop block.

4. The energy-saving recyclable display system according to claim 2, wherein, a semitransparent light guiding shell is arranged on the lower part of the illuminant, connecting to the lower part of the suspension loop shell.

5. The energy-saving recyclable display system according to claim 2, wherein, the stop block is round pie-shaped or cone-shaped and the bottom of the stop block horizontally protrudes outward.

6. The energy-saving recyclable display system according to claim 1, wherein, a semitransparent light guiding shell is arranged on the lower part of the illuminant, connecting to the lower part of the suspension loop shell.

7. The energy-saving recyclable display system according to claim 1, wherein, the stop block is round pie-shaped or cone-shaped and the bottom of the stop block horizontally protrudes outward.

8. The energy-saving recyclable display system according to claim 1, wherein, the packaging container is a packaging box or bag.

9. The energy-saving recyclable display system according to claim 1, wherein, the circuit board and the illuminant are electrically connected through a switch; the switch is arranged outside of the suspension loop.

* * * * *